US007934674B2

(12) United States Patent
Ota et al.

(10) Patent No.: US 7,934,674 B2
(45) Date of Patent: May 3, 2011

(54) YARN TRAVERSE GUIDE

(75) Inventors: Yasunori Ota, Ehime (JP); Yusuke Hamabe, Ehime (JP)

(73) Assignee: Toray Industries, Inc., Tokyo (JP)

( * ) Notice: Subject to any disclaimer, the term of this patent is extended or adjusted under 35 U.S.C. 154(b) by 0 days.

(21) Appl. No.: 12/649,712

(22) Filed: Dec. 30, 2009

(65) Prior Publication Data

US 2010/0102160 A1 Apr. 29, 2010

Related U.S. Application Data

(62) Division of application No. 12/162,542, filed as application No. PCT/JP2007/050948 on Jan. 23, 2007, now abandoned.

(30) Foreign Application Priority Data

Jan. 30, 2006 (JP) ..... 2006-020201

(51) Int. Cl.
*B65H 54/28* (2006.01)

(52) U.S. Cl. ..... 242/476.7; 242/615.3; 242/157.1

(58) Field of Classification Search .... 242/476.7–476.8, 242/477.1–478.2, 479.2–481, 481.2–481.5, 242/482.4–483.9, 484.2–484.5, 157.1, 157 R, 615.3

See application file for complete search history.

(56) References Cited

U.S. PATENT DOCUMENTS

| | | | |
|---|---|---|---|
| 2,202,937 A | 6/1940 | Wolfe | |
| 4,509,702 A | 4/1985 | Reese | |

FOREIGN PATENT DOCUMENTS

| | | | |
|---|---|---|---|
| JP | 25-010474 | | 12/1950 |
| JP | 58119565 A | * | 7/1983 |
| JP | 58-123862 U | | 8/1983 |
| JP | 59-149269 A | | 8/1984 |
| JP | 60061467 A | * | 4/1985 |
| JP | 02-132069 U | | 11/1990 |
| JP | 05-193835 A | | 8/1993 |

OTHER PUBLICATIONS

International Search Report for International Application No. PCT/JP2007/050948, dated Mar. 6, 2007.
Office Action dated Jul. 31, 2009 in U.S. Appl. No. 12/162,542.

* cited by examiner

*Primary Examiner* — William E Dondero
(74) *Attorney, Agent, or Firm* — RatnerPrestia

(57) ABSTRACT

A yarn traverse guide in which a plurality of yarn guides having yarn introducing openings and yarn introducing passages formed continuously from the yarn introducing openings are disposed at intervals so that the positions of the yarn introducing openings are not overlapped with each other.

12 Claims, 8 Drawing Sheets

YARN TRAVERSE GUIDE

CROSS REFERENCE TO RELATED APPLICATIONS

This application is a divisional patent application of U.S. patent application Ser. No. 12/162,542, filed on Jul. 29, 2008 (which is incorporated by reference herein in its entirety), which application is a U.S. National Phase Application of PCT International Application No. PCT/JP2007/050948, filed Jan. 23, 2007 (which is incorporated by reference herein in its entirety), which claims priority of Japanese Patent Application No. 2006-020201, filed Jan. 30, 2006.

TECHNICAL FIELD

The present invention relates to a yarn traverse guide used in a yarn winder that winds a running yarn around a rotating bobbin while traversing the yarn.

BACKGROUND ART

A yarn winder for winding a running yarn around a rotating bobbin while traversing the yarn comprises a yarn traverse guide for guiding and traversing the running yarn in the axial direction of the bobbin. As one of yarn traverse guides, known is a yarn traverse guide having two free rollers (free rotating rollers) disposed in parallel to each other through a clearance between them, for controlling the running of a yarn against the force acting on the yarn in the yarn running direction (tension) and the force acting on the yarn in the traverse direction.

In this yarn traverse guide, the yarn running toward the winding bobbin passes through the clearance between the two free rollers, and the two free rollers are traversed in the axial direction of the winding bobbin, to traverse the running yarn in the axial direction of the winding bobbin while the yarn is wound around the winding bobbin.

However, this yarn traverse guide has a problem that the operation of introducing the yarn into the yarn traverse guide is very difficult. To address this problem, a yarn traverse guide comprising a ring guide and two free rollers disposed in parallel to each other through a clearance between them is proposed in Patent Document 1. The ring guide has an opening communicating from outside to inside the ring guide at the position corresponding to the clearance between the two free rollers. The yarn is introduced from the opening into the clearance between the two free rollers.

This conventional technique has greatly improved the convenience of introducing the yarn into the yarn traverse guide. However, with this conventional technique, if the force in the yarn running direction or the force in the direction crossing the yarn running direction but different from the traverse direction (hereinafter this direction is merely called the direction different from the traverse direction) acts on the yarn, the position control of the running yarn by the yarn traverse guide cannot be performed. That is, the conventional technique has a disadvantage that the yarn can deviate from the yarn traverse guide, not being able to be traversed any more.

In recent years, especially a turret (revolving) type yarn winder as proposed in Patent Document 2 is popularly used. With the turret (revolving) type yarn winder, in the turret (revolving) movement or yarn cutting by a cutter when the yarn is transferred from a fully loaded bobbin to an empty bobbin, the yarn deviates from the yarn traverse guide, since the force in the axial direction of the free rollers acts on the yarn. If this phenomenon occurs, there arise such problems that the yarn deviating from the yarn traverse guide and running toward the fully loaded bobbin is kept in sliding contact with the frame of the winder, to be damaged and that the cutting of the yarn by the cutter for transferring the yarn to an empty bobbin cannot be performed.

On the other hand, Patent Document 3 proposes a yarn traverse guide capable of relatively stably controlling the yarn passage, namely, a yarn traverse guide that allows stable yarn traversing without causing the yarn to deviate from the yarn traverse guide even if the force in the yarn traveling direction and the force in the direction different from the traverse direction act on the yarn.

In this yarn traverse guide, a yarn disengagement prevention hook crossing a yarn arresting groove formed near a yarn guide portion is provided near the opening of the yarn arresting groove. If this yarn traverse guide is used, the yarn can be stably traversed without deviating from the yarn traverse guide even if the force in the yarn running direction and the force in the direction different from the traverse direction act on the yarn. However, the yarn traverse guide has a problem that the operation of introducing the yarn into the yarn traverse guide is difficult, since the yarn disengagement prevention hook is obtrusive.

Patent Document 1: JP 58-123862 U
Patent Document 2: JP 05-193835 A
Patent Document 3: JP 02-132069 U

SUMMARY OF THE INVENTION

The invention provides a yarn traverse guide that allows the yarn passage to be stably controlled against not only the force in the yarn running direction but also the force in the direction different from the traverse direction and also allows easy yarn threading.

A yarn traverse guide is provided comprising (a) a first guide member forming a first yarn guide, (b) a second guide member forming a second yarn guide, and (c) a guide attaching member for fixing the first guide member and the second guide member, wherein (d) the first guide member has a first yarn introducing port formed in a peripheral segment thereof and a first yarn introducing passage extending from the first yarn introducing port to inward of the first guide member, (e) the second guide member has a second yarn introducing port formed in a peripheral segment thereof and a second yarn introducing passage extending from the second yarn introducing port to inward of the second guide member, and (f) the first yarn guide and the second yarn guide are fixed to the guide attaching member in facing to each other through a clearance between them in such a state that when the first yarn introducing port and the second yarn introducing port are projected on the same plane of projection, they do not overlap each other and in such a state that when the first yarn introducing passage and the second yarn introducing passage are projected on the same plane of projection, they overlap each other at least partially.

In the yarn traverse guide according to an exemplary embodiment of the invention, it is preferred that the angle formed between the first direction in which the center line of the first yarn introducing passage extends from the first yarn introducing port to outward of the first guide member and the second direction in which the center line of the second yarn introducing passage extends from the second yarn introducing port to outward of the second guide member is more than 0 degree to less than 180 degrees on the same plane of projection.

In the yarn traverse guide according to an exemplary embodiment of the invention, it is preferred that at least either the center line of the first yarn introducing passage or the center line of the second yarn introducing passage is straight.

In the yarn traverse guide according to an exemplary embodiment of the invention, it is preferred that the first yarn introducing passage and/or the second yarn introducing passage communicate(s), at their/its end(s), with a yarn introducing passage extension(s) extending in the direction(s) different from the direction(s) of the center line(s) of the yarn introducing passage(s) concerned.

In the yarn traverse guide according to an exemplary embodiment of the invention, it is preferred that the peripheral segment(s) including the yarn introducing port(s) of the first guide member and/or the second guide member are/is formed to be curved outward of the first guide member and/or the second guide member.

In the yarn traverse guide according to an exemplary embodiment of the invention, it is preferred that each of both the first guide member and the second guide member is a plate-like body.

In the yarn traverse guide according to an exemplary embodiment of the invention, it is preferred that either the first guide member or the second guide member is a plate-like body while the other guide member comprises two bars parallel to each other.

In the yarn traverse guide according to an exemplary embodiment of the invention, it is preferred that each of the two bars is a rotatable roller (free roller).

In the yarn traverse guide according to an exemplary embodiment of the invention, it is preferred that the yarn introducing passage of the plate-like body communicates at its end with a yarn introducing passage extension extending in the direction different from the direction of the center line of the yarn introducing passage, and that in the case where the yarn introducing passage extension and the yarn introducing passage formed between the rotatable rollers are projected on the same plane of projection, they agree with each other in direction.

In the yarn traverse guide according to an exemplary embodiment of the invention, even in the case where the force in the yarn running direction and the force in the direction different from the traverse direction act on the yarn, the yarn does not deviate from the yarn traverse guide, and the state where the yarn is stably arrested by the yarn traverse guide can be sustained. The yarn traverse guide of the invention allows the yarn to be easily threaded (introduced) into the yarn traverse guide. The yarn traverse guide of the invention can be suitably used in a yarn winder such as a turret (revolving) type yarn winder, in which the force in the yarn running direction and the force in the direction different from the traverse direction act on the yarn during the automatic transfer of the yarn from a fully loaded bobbin to an empty bobbin, though such forces do not act on the yarn in the steady winding state.

MEANINGS OF SYMBOLS

Figure 1:
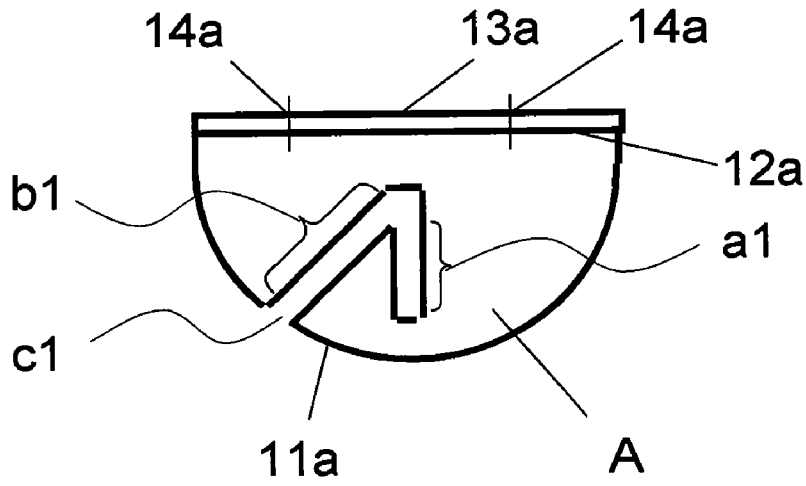
FIG. 1 is a schematic top view showing a first yarn guide in an embodiment of the yarn traverse guide of the invention.

A: first guide member
B: second guide member
C: first guide member
D: second guide member
TG1: yarn traverse guide
TG2: yarn traverse guide
YW1: yarn winder
YW2: yarn winder
a1: first yarn introducing passage extension (yarn holding passage)
a2: second yarn introducing passage extension (yarn holding passage)
a3: first yarn introducing passage extension (yarn holding passage)
b1: first yarn introducing passage
b1*c*: center line
b2: second yarn introducing passage
b2*c*: center line
b3: first yarn introducing passage
b3*c*: center line
b4: second yarn introducing passage
b4*c*: center line c1: first yarn introducing port
c2: second yarn introducing port
c3: first yarn introducing port
c4: second yarn introducing port
d1: angle
d2: angle
e: clearance
1: yarn
1*a*: yarn
2: traverse guide rail
2*a*: traverse guide rail
3: pressure roller
3*a*: pressure roller
4: yarn package
4*a*: yarn package
5: winding bobbin
5*a*: winding bobbin
6*a*: bar (free roller)
6*b*: bar (free roller)
7: guide attaching member (guide support)
7*a*: guide attaching member (guide support)
11*a*: peripheral segment
11*b*: peripheral segment
12*a*: peripheral segment
12*b*: peripheral segment
13*a*: guide member attaching portion
13*b*: guide member attaching portion
14*a*: screw hole
14*b*: screw hole
15*a*: screw
15*b*: screw
16*a*: first direction
16*b*: second direction
20: space portion
21*a*: peripheral segment
22*a*: peripheral segment
23*a*: guide member attaching portion
23*b*: guide member attaching portion
24*a*: screw hole
24*b*: screw hole
25*a*: screw
25*b*: screw
26*a*: first direction
26*b*: second direction

DETAILED DESCRIPTION

Embodiments of the yarn traverse guide of the invention are explained below in reference to the drawings.

The yarn traverse guide of the invention comprises a first guide member forming a first yarn guide, a second guide member forming a second yarn guide, and a guide attaching member for fixing these yarn guides in certain positional relationships. FIGS. 1 through 4 show an embodiment of the yarn traverse guide of the invention.

FIG. 1 is a top view showing a first guide member A forming a first yarn guide. In FIG. 1, the first guide member A is formed as a semi-circular plate-like body. The first guide member A has a first yarn introducing port c1 formed in a portion of a semi-circular peripheral segment 11*a* and a first yarn introducing passage b1 extending from the first yarn introducing port c1 to inward of the first guide member A. The first yarn introducing port c1 and the first yarn introducing passage b1 communicating with it are formed with a slit provided in the plate-like body.

The straight peripheral segment 12*a* of the first guide member A is bent upward to form a guide member attaching portion 13*a*. The guide member attaching portion 13*a* has screw holes 14*a* used for attaching.

The yarn passage of the yarn is formed in the direction from the top side of the first guide member A toward the bottom side, or in the direction from the bottom side toward the top side. For threading the yarn into the first yarn guide, the yarn is introduced from the first yarn introducing port c1 into the first yarn introducing passage b1.

In the first guide member A, the first yarn introducing passage b1 communicates, at its end, with a first yarn introducing passage extension (yarn holding passage) a1 extending in the direction different from the direction of the center line of the first yarn introducing passage b1. In FIG. 1, the center line of the first yarn introducing passage b1 is straight, but the center line can also be curved. In the case of a curve, it is preferred that the curve is smoothly bent, since the yarn moves along the first yarn introducing passage b1 while it runs in the vertical direction.

Figure 2:
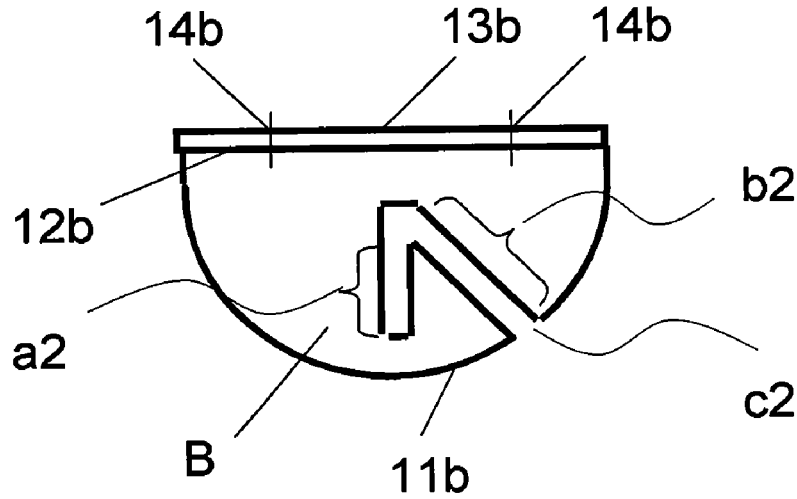
FIG. 2 is a schematic top view showing a second yarn guide in the embodiment of the yarn traverse guide of the invention, used in combination with the first yarn guide of FIG. 1.

FIG. 2 is a top view showing a second guide member B forming a second yarn guide. In FIG. 2, the second guide member B is formed as a semi-circular plate-like body. The second guide member B has a second yarn introducing port c2 formed in a portion of a semi-circular peripheral segment 11*b* and a second yarn introducing passage b2 extending from the second yarn introducing port c2 to inward of the second guide member B. The second yarn introducing port c2 and the second yarn introducing passage b2 communicating with it are formed as a slit in the plate-like body.

The straight peripheral segment 12*b* of the second guide member B is bent downward to form a guide member attaching portion 13*b*. The guide member attaching portion 13*b* has screw holes 14*b* used for attaching.

The yarn passage of the yarn is formed in the direction from the top side of the second guide member B toward the bottom side, or in the direction from the bottom side toward the top side. For threading the yarn into the second yarn guide, the yarn is introduced from the second yarn introducing port c2 into the second yarn introducing passage b2.

In the second guide member B, the second yarn introducing passage b2 communicates, at its end, with a second yarn introducing passage extension (yarn holding passage) a2 extending in the direction different from the direction of the center line of the second yarn introducing passage b2. In FIG. 2, the center line of the second yarn introducing passage b2 is straight, but the center line can also be curved. In the case of a curve, it is preferred that the curve is smoothly bent, since the yarn moves along the second yarn introducing passage b2 while it runs in the vertical direction.

Figure 3:
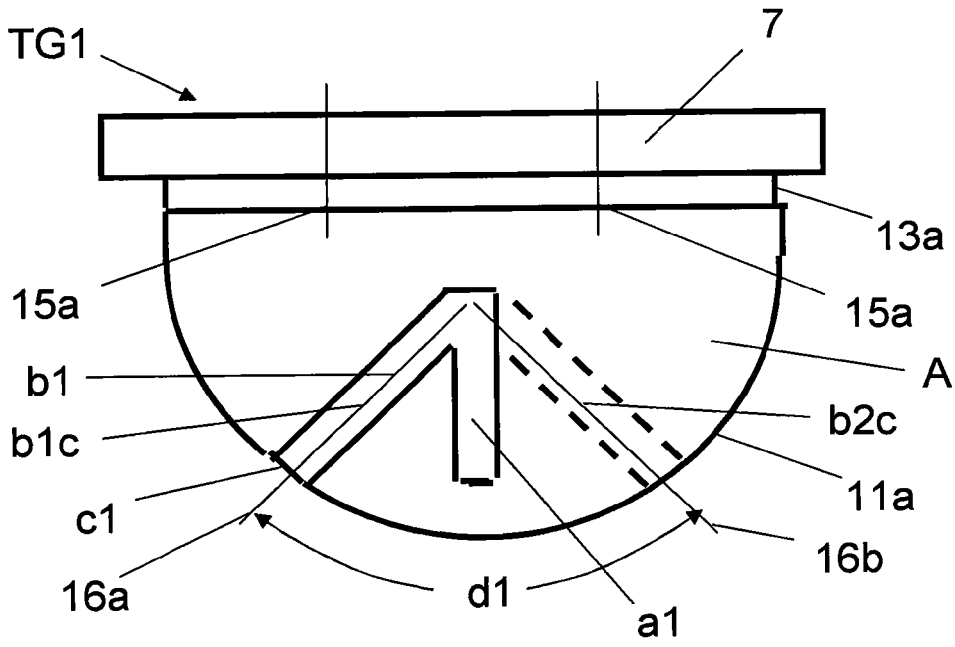
FIG. 3 is a schematic top view showing the embodiment of the yarn traverse guide of the invention, using the combination comprising the first yarn guide of FIG. 1 and the second yarn guide of FIG. 2.
Figure 4:
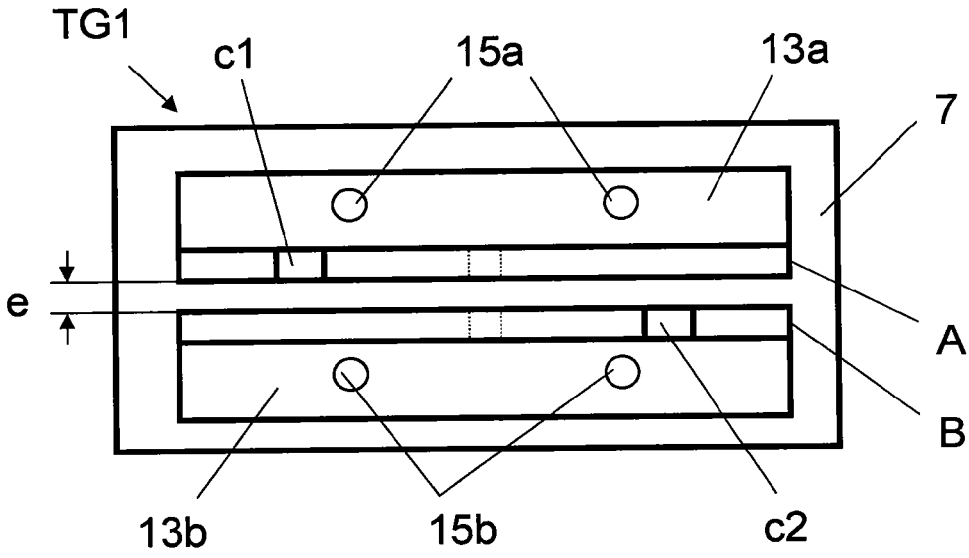
FIG. 4 is a schematic front view showing the yarn traverse guide of FIG. 3.

FIG. 3 is a schematic top view showing an embodiment of the yarn traverse guide of the invention, using the combination comprising the first yarn guide of FIG. 1 and the second yarn guide of FIG. 2. FIG. 4 is a schematic front view showing the yarn traverse guide of FIG. 3. In FIGS. 3 and 4, the yarn traverse guide TG1 comprises the first guide member A forming the first yarn guide, the second guide member B forming the second yarn guide, and a guide attaching member (guide support) 7 fixing these members.

In the upper portion of the guide support 7, the first guide member A is fixed to the guide support 7 by the screws 15*a* inserted into the screw holes 14*a* formed in the guide member attaching portion 13*a*. In the lower portion of the guide support 7, the second guide member B is fixed to the guide support 7 by the screws 15*b* inserted in the screw holes 14*b* formed in the guide member attaching portion 13*b*, in facing to the first guide member A, with a clearance e formed against the first guide member A.

The first guide member A and the second guide member B are fixed to the guide support 7 in such a manner as to establish the following three positional relationships.

The first positional relationship is such that when the first yarn introducing port c1 and the second yarn introducing port c2 are projected on the same plane of projection, they do not overlap each other. In this positional relationship, it can be prevented that the running yarn traversed by the yarn traverse guide TG1 deviates from the yarn traverse guide TG1 during traversing.

The second positional relationship is such that when the first yarn introducing passage b1 and the second yarn introducing passage b2 are projected on the same plane of projection, they overlap each other at least partially. In this positional relationship, the running yarn traversed can pass through the yarn traverse guide TG1 straight in the steady state of traversing.

The third positional relationship is such that the first guide member A and the second guide member B keep a clearance e between them. In this positional relationship, the yarn can be easily threaded into the yarn traverse guide TG1. That is, this positional relationship facilitates the introduction of the yarn from the first yarn introducing port c1 of the first guide member A into the first yarn introducing passage b1 and the introduction of the yarn from the second yarn introducing port c2 of the second guide member B into the second yarn introducing passage b2.

The dimension of the clearance e is selected, considering the thickness of the wound yarn, etc., and it is preferred that the dimension is in the range of 1 mm to 50 mm. A more preferred range is 5 mm to 10 mm.

FIG. 3 shows the angle d1 formed between the first direction 16*a* in which the center line b1*c* of the first yarn introducing passage b1 extends from the first yarn introducing port c1 to outward of the first guide member A and the second direction 16*b* in which the center line b2*c* of the second yarn introducing passage b2 extends from the yarn introducing port c2 to outward of the second guide member B. It is preferred that the angle d1 is in the rage of more than 0 degree to less than 180 degrees, for such reasons that it can be prevented that the yarn is disengaged from the yarn traverse guide TG1 while the yarn is traversed, and that the threading of the yarn into the yarn traverse guide TG1 can be facilitated. It is more preferred that the angle d1 is in the range of 1 degree to 90 degrees.

In FIGS. 1 through 3, the center line b1*c* of the first yarn introducing passage b1 and the center line b2*c* of the second yarn introducing passage b2 are respectively straight, but they can also be curved. In the case where the center line is a curve, the first direction 16*a* at the first yarn introducing port c1 is the tangential direction of the curve at the first yarn introducing port c1, or the second direction 16*b* at the second yarn introducing port c2 is the tangential direction of the curve at the second yarn introducing port c2. It is preferred that the center lines b1*c* and b2*c* and the first and second yarn introducing passages b1 and b2 are respectively straight, since the threading of the yarn into the yarn traverse guide TG1 is easier.

In the embodiment shown in FIGS. 1 through 4, further, the first yarn introducing passage extensional is formed in the first guide member A, and the second yarn introducing passage extension a2 is formed in the second guide member B. The first yarn introducing passage extensional and the second yarn introducing passage extension a2 are in such a positional relationship that when they are projected on the same plane of projection, they overlie each other.

The first yarn introducing passage extensional and the second yarn introducing passage extension a2 are not essential in the yarn traverse guide of the invention. However, they allow the yarn to be more stably controlled by the yarn traverse guide. That is, the first yarn introducing passage extensional and the second yarn introducing passage extension a2 allow the yarn to be traversed more stably without allowing the yarn to deviate from the yarn traverse guide even in the case where the force in the yarn running direction and the force in the direction different from the traverse direction act on the yarn. So, it is preferred that the first yarn introducing passage extensional is provided at the end of the first yarn introducing passage b1 and that the second yarn introducing passage extension a2 is provided at the end of the second yarn introducing passage b2. Meanwhile, in the case where the first yarn introducing passage extension a1 and the second yarn introducing passage extension a2 do not exist, the yarn passes through the first yarn introducing passage b1 of the first guide member A and the second yarn introducing passage b2 of the second guide member B.

It is preferred that the peripheral segment 11*a* including the first yarn introducing port c1 of the first guide member A is formed to be curved outward of the first guide member A as shown in FIG. 1, and/or that the peripheral segment 11*b* including the second yarn introducing port c2 of the second guide member B is formed to be curved outward of the second guide member B as shown in FIG. 2.

In the case where the peripheral segment(s) 11*a* and/or the peripheral segment 11*b* are/is curved outward of the guide member(s), when the yarn traverse guide TG1 is driven for traversing, the yarn introduced from the yarn introducing port c1 or c2 of one yarn guide into the yarn introducing passage b1 or b2 moves on the curved surface formed by the peripheral segment 11*a* or 11*b* of the other yarn guide, being introduced from the yarn introducing port c1 or c2 of the yarn guide into the yarn introducing passage b1 or b2. Thus, the yarn can be automatically passed into the yarn traverse guide TG1 and introduced into the steady traverse position in the yarn introducing passage.

Figure 5:
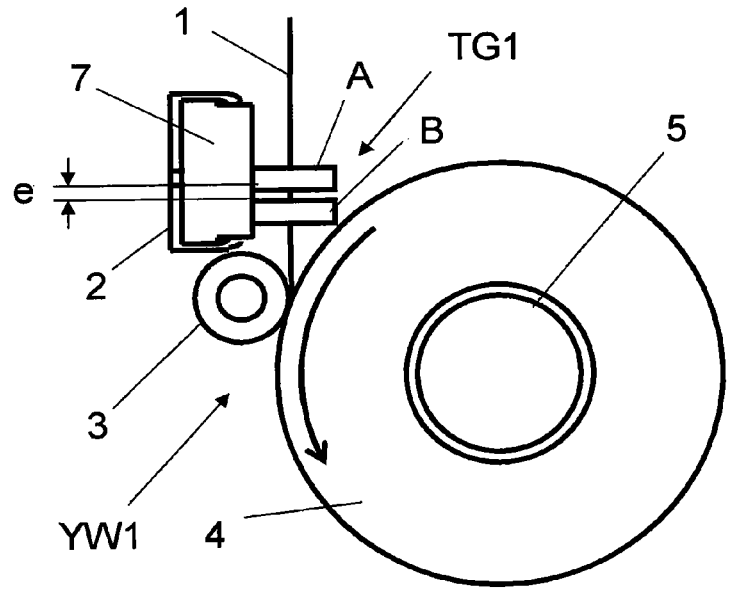
FIG. 5 is a schematic side view showing a portion of a yarn winder to which the yarn traverse guide of FIG. 3 is attached.

FIG. 5 is a schematic side view showing a portion of a yarn winder YW1 equipped with the yarn traverse guide TG1 of the invention shown in FIGS. 3 and 4. The yarn winder YW1 per se is a known conventional yarn winder.

FIG. 5 shows a rotating winding bobbin 5, a yarn package 4 formed around the winding bobbin 5, a pressure roller 3 rotating in contact with the surface of the yarn package 4, a transverse guide rail 2 positioned in the axis direction of the winding bobbin 5 above the pressure roller 3, a yarn traverse guide TG1 supported by the traverse guide rail 2 for traversing in the direction of the traverse guide rail 2, and a yarn 1 traversed by the yarn traverse guide TG1 while being wound around the winding bobbin 5 and while being kept in contact with the pressure roller 3.

In FIG. 5, the support and drive mechanisms of the winding bobbin 5, the support and drive mechanisms of the pressure roller 3, the support mechanism of the traverse guide rail 2 and the drive mechanism of the yarn traverse guide TG1 are not shown, but they are widely known as conventional mechanisms.

Figure 6:
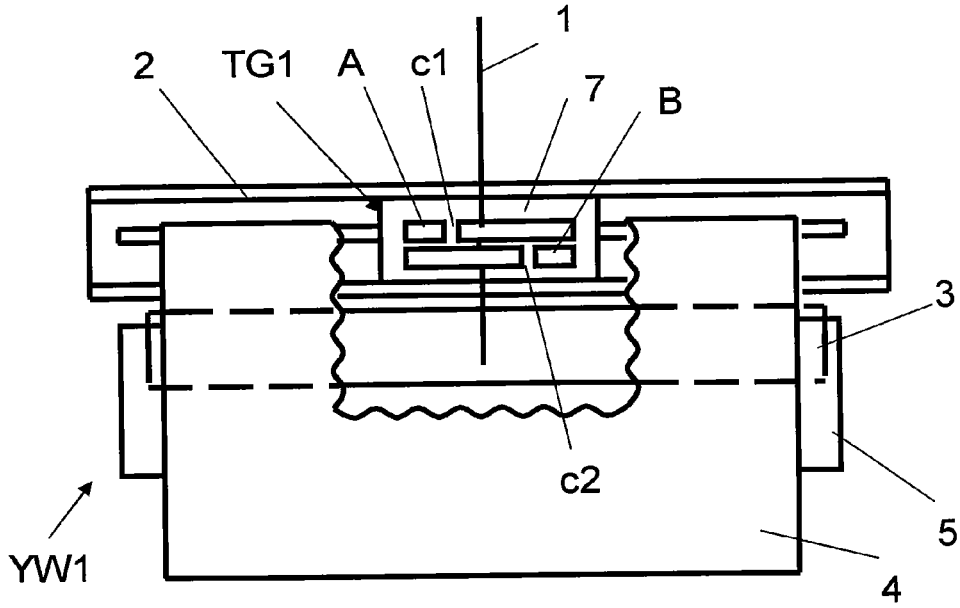
FIG. 6 is a schematic front view showing the yarn winder of FIG. 5, in which the yarn traverse guide is located almost at the center of the traverse width.
Figure 7:
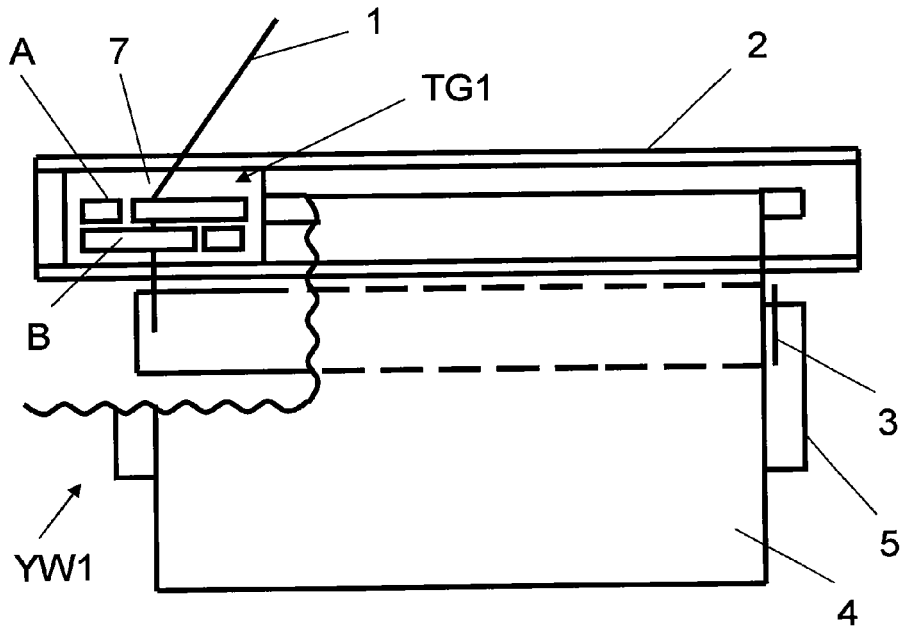
FIG. 7 is a schematic front view showing the yarn winder of FIG. 5, in which the yarn traverse guide is located at the left end of the traverse width.
Figure 8:
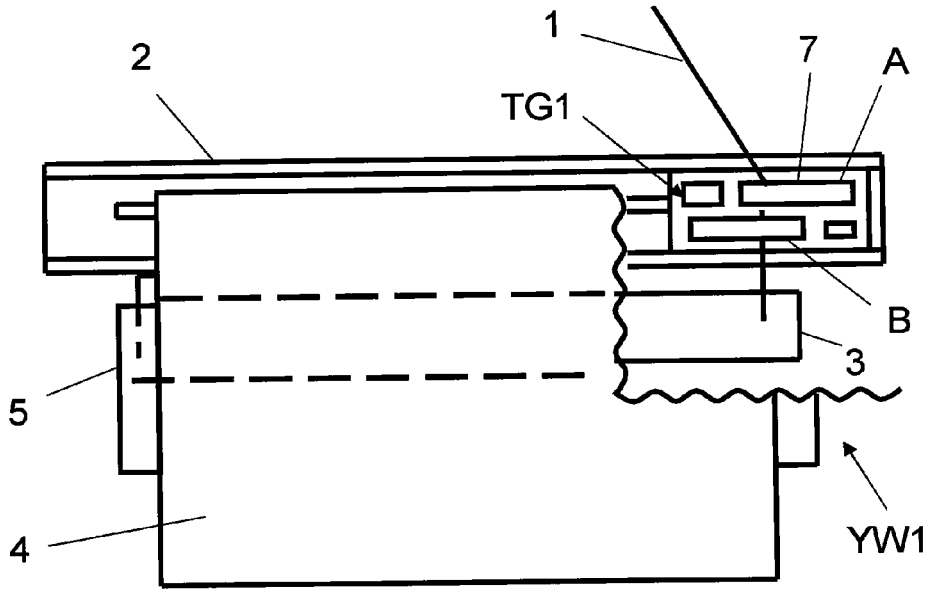
FIG. 8 is a schematic front view showing the yarn winder of FIG. 5, in which the yarn traverse guide is located at the right end of the traverse width.

FIGS. 6, 7 and 8 are schematic front views of the yarn winder YW1 of FIG. 5. FIG. 6 shows the state where the yarn traverse guide TG1 is located at the center of the traverse width. FIG. 7 shows the state where yarn traverse guide TG1 is located at the left end of the traverse width. FIG. 8 shows the state where the yarn traverse guide TG1 is located at the right end of the traverse width.

The yarn traverse guide TG1 moves continuously rightward in the drawings along the traverse guide rail 2 over a desired traverse width from the position of the yarn traverse guide TG1 shown in FIG. 7, via the position of the yarn traverse guide TG1 shown in FIG. 6 to the position of the yarn traverse guide TG1 shown in FIG. 8. Then, the yarn traverse guide TG1 changes its direction, to move leftward, for completing one cycle of reciprocation. Thereafter, the reciprocation is continued, and during the continued reciprocation, the running yarn 1 is wound around the winding bobbin 5 while being traversed by the yarn traverse guide TG1, to form the yarn package 4.

FIGS. 9 through 12 show another embodiment of the yarn traverse guide of the invention.

Figure 9:
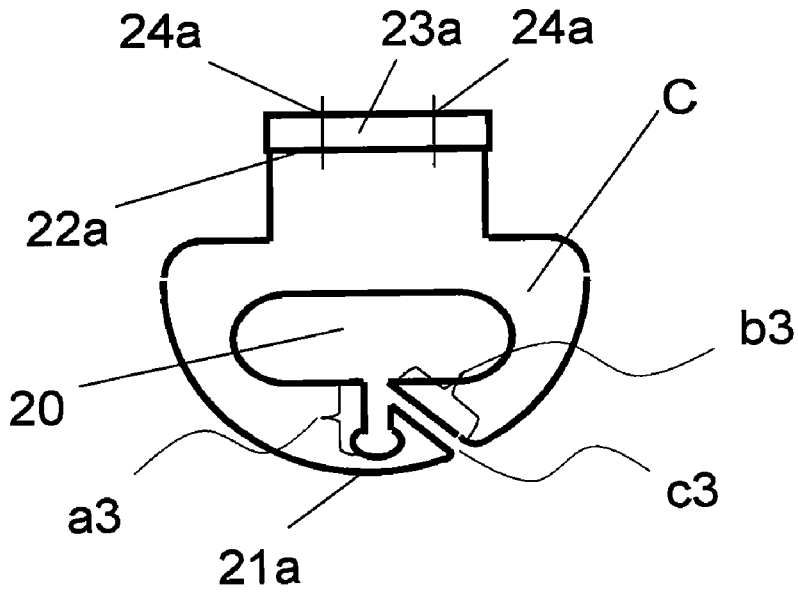
FIG. 9 is a schematic top view showing a first yarn guide in another embodiment of the yarn traverse guide of the invention.

FIG. 9 is the top view of a first guide member C forming a first yarn guide. In FIG. 9, the first guide member C is formed as a semi-circular plate-like body, and has a space portion 20 inward of the plate-like body. The first guide member C has a first yarn introducing port c3 formed in a portion of a semi-circular peripheral segment 21*a* and a first yarn introducing passage b3 extending from the first yarn introducing port c3 toward the space portion 20. The first yarn introducing port c3 and the first yarn introducing passage b3 communicating with it are formed with a slit provided in the plate-like body.

The straight peripheral segment 22*a* on the side opposite to the semi-circular peripheral segment 21*a* of the first guide member C is bent upward, to form a guide member attaching portion 23*a*. The guide member attaching portion 23*a* has screw holes 24*a* formed for attaching.

The yarn passage of the yarn is formed in the direction from the top side of the first guide member C toward the bottom side, or in the direction from the bottom side toward the top side. For threading the yarn into the first yarn guide, the yarn is introduced from the first yarn introducing port c3 into the first yarn introducing passage b3.

In the first guide member C, further, the first yarn introducing passage b3 communicates, at its end, with a first yarn introducing passage extension (yarn holding passage) a3 extending in the direction different from the direction of the center line of the first yarn introducing passage b3. FIG. 9 shows a case where the center line of the first yarn introducing passage b3 is straight, but it can also be curved. In the case of a curve, it is preferred that the curve is smoothly curved, since the yarn moves along the first yarn introducing passage b3 while running in the vertical direction. The first yarn introducing passage extension a3 is open on the space portion 20 side to the space portion 20.

The first yarn introducing passage extension a3 is not essential in the yarn traverse guide of the invention. However, if the yarn traverse guide has the first yarn introducing passage extension a3, the yarn can be more stably controlled by the yarn traverse guide. That is, owing to the first yarn introducing passage extension a3, even in the case where the force in the yarn running direction and the force in the direction different from the traverse direction act on the yarn, the yarn is not disengaged from the yarn traverse guide and can be traversed more stably. Therefore, it is preferred that the first yarn introducing passage extension a3 is formed at the end of the first yarn introducing passage b3. Meanwhile, in the case where the first yarn introducing passage extension a3 does not exist, the yarn passes through the first yarn introducing passage b3 and the space portion 20.

Figure 10:
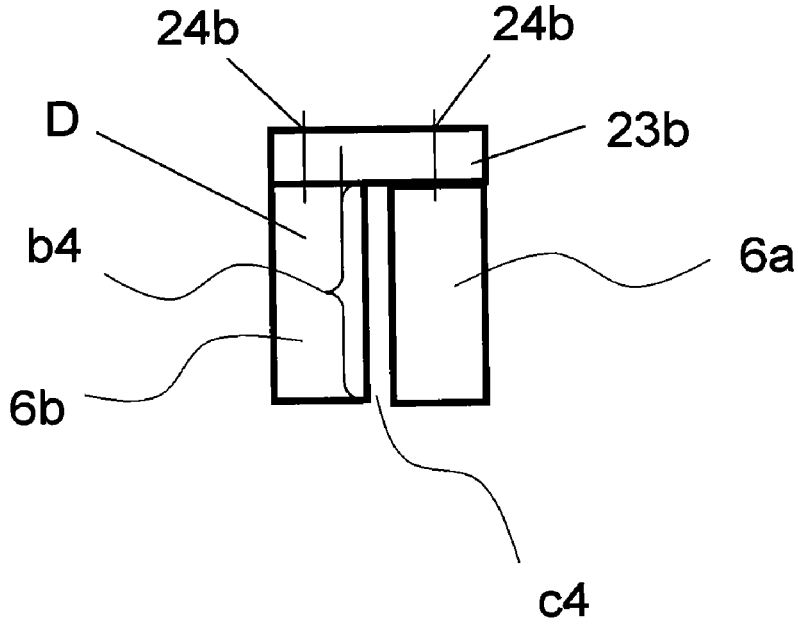
FIG. 10 is a schematic top view showing a second yarn guide in the other embodiment of the yarn traverse guide of the invention, used in combination with the first yarn guide of FIG. 9.

FIG. 10 is a top view showing a second guide member D forming a second yarn guide. In FIG. 10, the second guide member D comprises two bars 6*a* and 6*b* disposed parallel to each other with a clearance kept between them, and a guide member attaching portion 23*b* to which the two bars 6*a* and 6*b* are attached. The clearance between the two bars 6*a* and 6*b* forms a second yarn introducing passage b4, and the inlet of the clearance forms a second yarn introducing port c4. The guide member attaching portion 23*b* has screw holes 24*b* formed for attaching.

The yarn passage of the yarn is formed in the direction from the top side of the second guide member D toward the bottom side, or in the direction from the bottom side toward the top side. For introducing the yarn into the second yarn guide, the yarn is introduced from the second yarn introducing port c4 into the second yarn introducing passage b4.

In FIG. 10, the two bars 6*a* and 6*b* are free rollers rotatably attached to the guide member attaching portion 23*b*, but can also be non-rotating fixed bars. However, since the running yarn is introduced into the second yarn introducing passage b4 and runs in contact with the two bars 6*a* and 6*b* during traversing, it is preferred that the two bars 6*a* and 6*b* are free rollers for decreasing the damage to the yarn.

Figure 11:
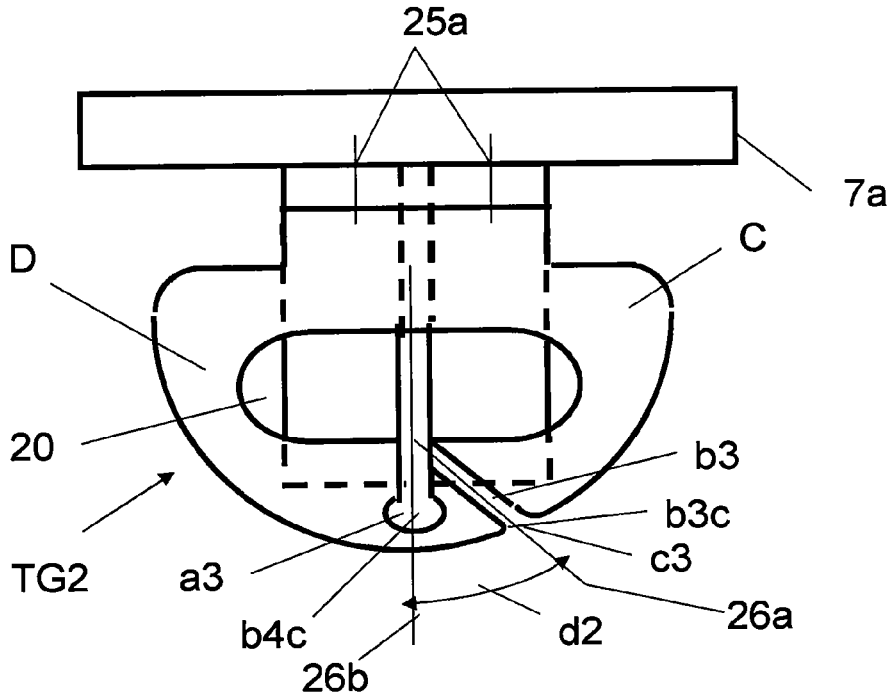
FIG. 11 is a schematic top view showing the other embodiment of the yarn traverse guide of the invention, using the combination comprising the first yarn guide of FIG. 9 and the second yarn guide of FIG. 10.
Figure 12:
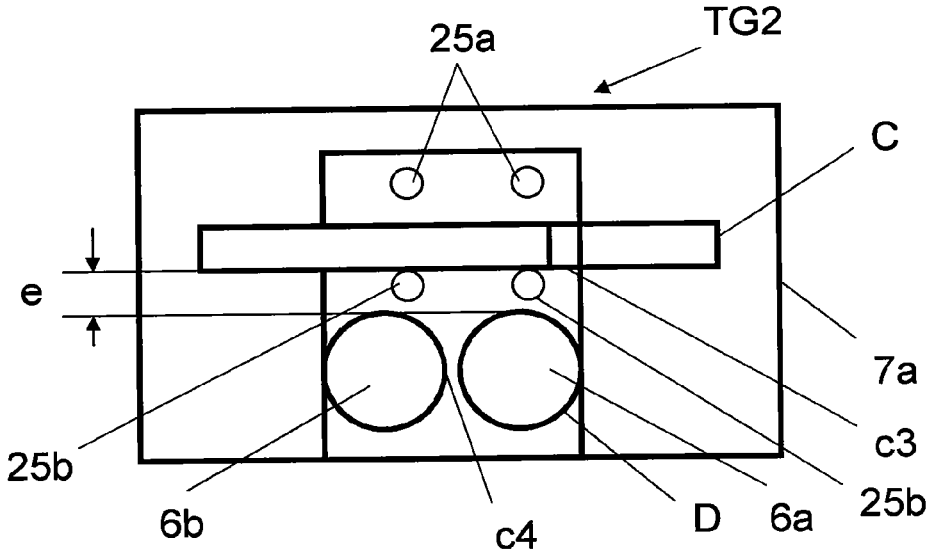
FIG. 12 is a schematic front view showing the yarn traverse guide of FIG. 11.

FIG. 11 is a schematic top view of the other embodiment of the yarn traverse guide of the invention, using the combination comprising the first yarn guide of FIG. 9 and the second yarn guide of FIG. 10. FIG. 12 is a schematic front view showing the yarn traverse guide of FIG. 11. In FIGS. 11 and 12, the yarn traverse guide TG2 comprises the first guide member C forming the first yarn guide, the second guide member D forming the second yarn guide, and a guide attaching member (guide support) 7*a* to which these members are fixed.

The first guide member C is fixed to the guide support 7*a* by the screws 25*a* inserted in the screw holes 24*a* formed in the guide member attaching portion 23*a* in the upper portion of the guide support 7*a*. The second guide member D is fixed to the guide support 7*a* by the screws 25*b* inserted in the screw holes 24*b* formed in the guide member attaching portion 23*b*, with a clearance e formed against the first guide member C, in the lower portion of the guide support 7*a*.

The first guide member C and the second guide member D are fixed to the guide support 7*a* in such a manner as to establish the following three positional relationships.

The first positional relationship is such that when the first yarn introducing port c3 and the second yarn introducing port c4 are projected on the same plane of projection, they do not overlap each other. In this positional relationship, it can be prevented that the running yarn traversed by the yarn traverse guide TG2 deviates from the yarn traverse guide TG2 during traversing.

The second positional relationship is such that when the first yarn introducing passage b3 and the second yarn introducing passage b4 are projected on the same plane of projection, they overlap each other at least partially. In this positional relationship, the running yarn traversed can pass through the yarn traverse guide TG1 straight in the steady state of traversing.

The third positional relationship is such that the first guide member C and the second guide member D keep a clearance e between them. In this positional relationship, the yarn can be easily threaded into the yarn traverse guide TG2. That is, this positional relationship facilitates the introduction of the yarn from the first yarn introducing port c3 of the first guide member C into the first yarn introducing passage b3 and the introduction of the yarn from the second yarn introducing port c4 of the second guide member D into the second yarn introducing passage b4. Meanwhile, the dimension of the clearance e is selected as in the case of the abovementioned yarn traverse guide TG1.

FIG. 11 shows the angle d2 formed between the first direction 26*a* in which the center line b3*c* of the first yarn introducing passage b3 extending from the first yarn introducing port c3 to outward of the first guide member C and the second direction 26*b* in which the center line b4*c* of the second yarn introducing passage b4 extending from the second yarn introducing port c4 to outward of the second guide member D. The value of the angle d2 is selected as in the case of the above-mentioned yarn traverse guide TG1.

In the yarn traverse guide TG2, to facilitate the introduction of the yarn into the yarn traverse guide TG2, it is preferred that when the first guide member C and the second guide member D are projected on the same plane of projection, the tips of the two bars (free rollers) 6*a* and 6*b* of the second guide member D are positioned inside the peripheral segment 21*a* of the first guide member C. In this case, if the first guide member C has the first yarn introducing passage extension a3, it is more preferred for preventing the yarn from deviating from the yarn traverse guide TG2 that the first yarn introducing passage extension a3 and the second yarn introducing passage b4 of the second guide member D agree with each other in direction.

In the yarn traverse guide TG2, while the yarn is in the steady winding state, the running yarn passes through the second yarn introducing passage b4 of the second guide member D and is traversed by the bars (free rollers) 6*a* and 6*b*. In this state, it is preferred that when the first guide member C and the second guide member D are projected on the same plane of projection, the central position of the space portion 20 of the first guide member C and the position of the second yarn introducing passage b4 of the second guide member D agree with each other. In this positional relationship, while the yarn is in the steady winding state, the state in which the running yarn that is being traversed does not contact the first guide member C occurs, and the fuzz caused by the rubbing of the traversed running yarn by the first guide member C can be prevented. The yarn traverse guide TG2 having this positional relationship is suitable as a yarn traverse guide for a winder of a yarn such as carbon fibers likely to be fuzzed by rubbing contact with an object.

In the yarn traverse guide TG2, to facilitate the threading of the yarn into the yarn traverse guide TG2, it is preferred that the peripheral segment 21*a* of the first guide member C is formed to be curved outward. If the peripheral segment 21*a* is formed like this, the yarn can be automatically introduced into the first yarn introducing passage b3 from the first yarn introducing port c3 when the yarn traverse guide TG2 is driven for traversing and threading the yarn.

Figure 13:
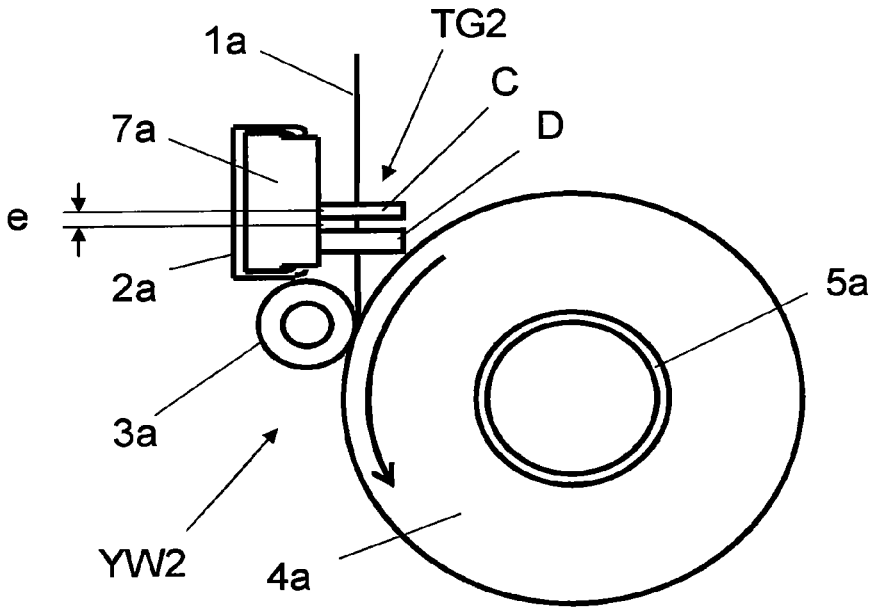
FIG. 13 is a schematic side view showing a portion of a yarn winder to which the yarn traverse guide of FIG. 11 is attached.

FIG. 13 is a schematic side view showing a portion of a yarn winder YW2 equipped with the yarn traverse guide TG2 of the invention shown in FIGS. 11 and 12. The yarn winder YW2 per se is a known conventional yarn winder.

FIG. 13 shows a rotating winding bobbin 5*a*, a yarn package 4*a* formed around the winding bobbin 5*a*, a pressure roller 3*a* rotating in contact with the surface of the yarn package 4*a*, a traverse guide rail 2*a* positioned in the axial direction of the winding bobbin 5*a*, above the pressure roller 3*a*, a yarn traverse guide TG2 supported by the traverse guide rail 2*a* for traversing in the direction of the traverse guide rail 2*a*, and a yarn 1*a* traversed by the yarn traverse guide TG2 while being wound around the winding bobbin 5*a* and while being kept in contact with the pressure roller 3*a*.

In FIG. 13, the support and drive mechanisms of the winding bobbin 5*a*, the support and drive mechanisms of the pressure roller 3*a*, the support mechanism of the traverse guide rail 2*a* and the drive mechanism of the yarn traverse guide TG2 are not shown, but they are widely known as conventional mechanisms.

Figure 14:
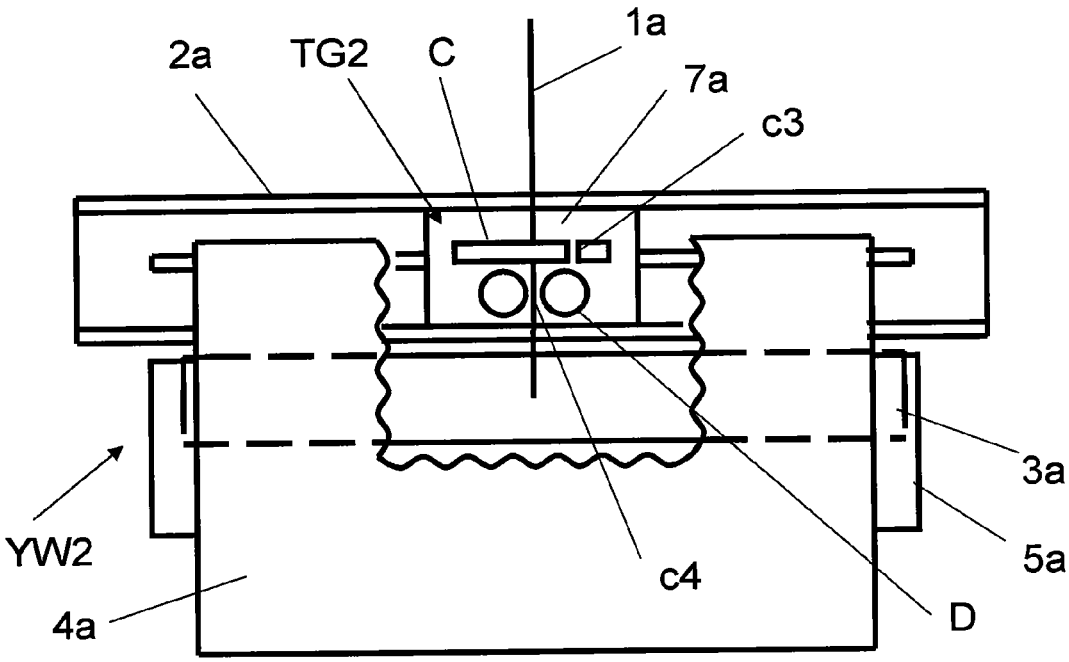
FIG. 14 is a schematic front view showing the yarn winder of FIG. 13, in which the yarn traverse guide is located almost at the center of the traverse width.
Figure 15:
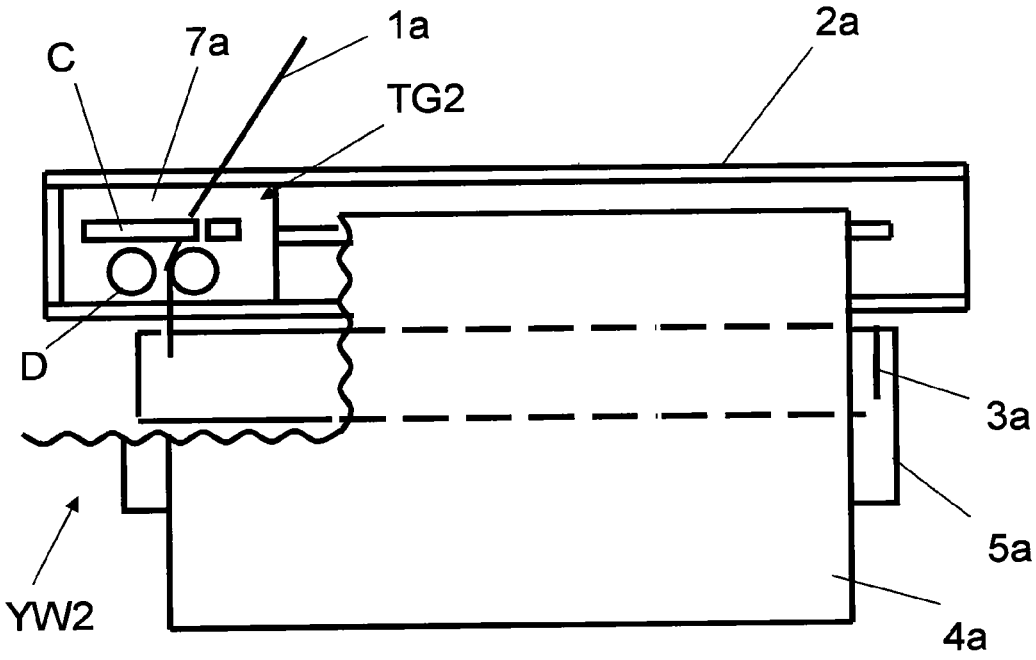
FIG. 15 is a schematic front view showing the yarn winder of FIG. 14, in which the yarn traverse guide is located at the left end of the traverse width.
Figure 16:
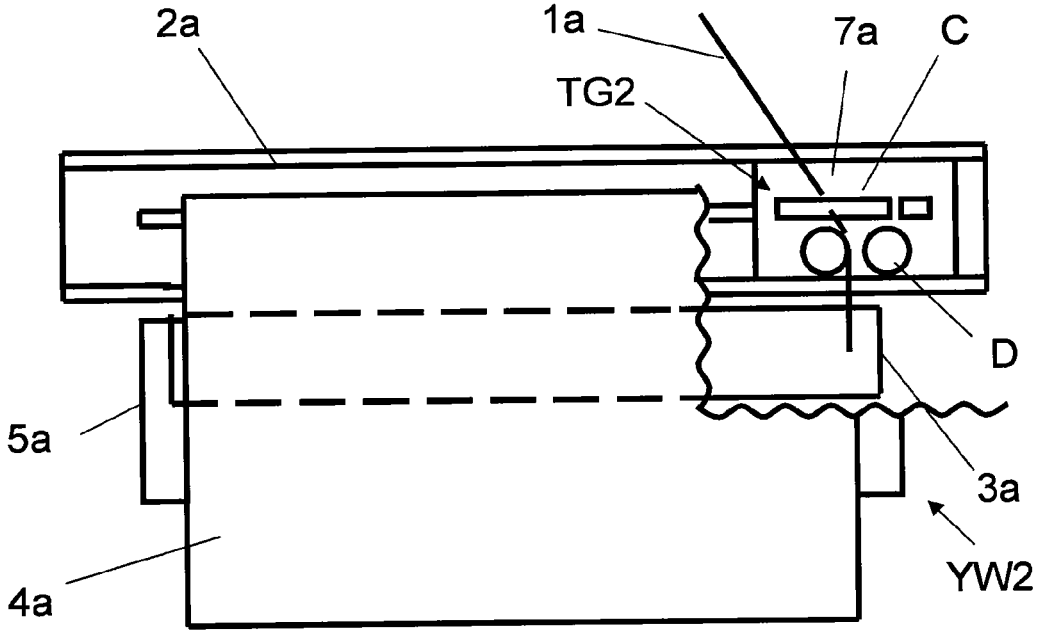
FIG. 16 is a schematic front view showing the yarn winder of FIG. 14, in which the yarn traverse guide is located at the right end of the traverse width.

FIGS. 14, 15 and 16 are schematic front views of the yarn winder YW2 of FIG. 13. FIG. 14 shows the state where the yarn traverse guide TG2 is located at the center of the traverse width. FIG. 15 shows the state where the yarn traverse guide TG2 is located at the left end of the traverse width. FIG. 16 shows the state where the yarn traverse guide TG2 is located at the right end of the traverse width.

The yarn traverse guide TG2 moves continuously rightward in the drawings along the traverse guide rail 2*a* over a desired traverse width from the position of the yarn traverse guide TG2 shown in FIG. 15, via the position of the yarn traverse guide TG2 shown in FIG. 14 to the position of the yarn traverse guide TG2 shown in FIG. 16. Then, the yarn traverse guide TG2 changes its direction, to move leftward, for completing one cycle of reciprocation. Thereafter, the reciprocation is continued, and during the continued reciprocation, the running yarn 1*a* is wound around the winding bobbin 5*a* while being traversed by the yarn traverse guide TG2, to form the yarn package 4*a*.

The yarn traverse guide TG1 and the yarn traverse guide TG2 explained above are modes in which a first yarn guide formed as a first guide member and a second yarn guide formed as a second guide member are installed together, but in the yarn traverse guide of the invention, the number of combined guides is not limited to two, and can also be three or more. However, considering the production cost of the yarn traverse guide and the maintenance of the yarn winder, a yarn traverse guide comprising two yarn guides is more economical.

The guide members used in the yarn traverse guide of the invention are only required to be made of a material having sufficient strength against the force applied by the yarn and the force applied by traverse motion. Examples of the material include carbon steel, stainless steel, ceramic, etc. It is preferred that the surface roughness of the guide members at the portions in contact with the yarn is 0.4 to 3.2 as the center line mean roughness Ra measured according to JIS B 0601.

Examples of the invention and comparative examples are explained below.

In the examples, whether or not a yarn could be stably traversed without deviating from the yarn traverse guide was observed while the force in the yarn running direction and the force in the direction different from the traverse direction were respectively allowed to act on the yarn. In this observation, the stability of yarn passage control was referred to as an indicator. Particularly, whether or not the yarn deviated from the yarn traverse guide whenever the winding bobbin (paper tube) was moved in the direction of leaving from the pressure roller was judged at five traverse sites, namely, by locating the yarn traverse guide traversing within a traverse width of 150 mm at 0 mm site (an end of the traverse width), 150 mm site (the other end of the traverse width), 75 mm site (the center of the traverse width), 37.5 mm site (the center between 0 mm site and 75 mm site), and 112.5 mm site (the center of 75 mm site and 150 mm site). The deviation of the yarn from the yarn traverse guide refers to the state where the yarn is disengaged from the yarn traverse guide and cannot be traversed by the yarn traverse guide any more.

In the examples, whether or not the yarn could be easily introduced (threaded) into the yarn traverse guide was judged as follows. A yarn was wound around a winding bobbin (paper tube) at the center, and the winding bobbin (paper tube) was kept in contact with the pressure roller. Then, whether or not the yarn could be automatically introduced into the yarn traverse guide during the first one cycle of traversing (reciprocation) and whether or not the yarn deviated from the yarn traverse guide during the next one cycle of traversing (reciprocation) were observed. A case where the yarn could be automatically introduced into the yarn traverse guide and did not deviate is expressed as "Good," and a case where the yarn could not be automatically introduced into the yarn traverse guide or deviated is expressed as "Poor."

EXAMPLE 1

The yarn traverse guide TG1 shown in FIG. 3 was attached to a turret (revolving) type yarn winder (EKTW-CA winder produced by Kamitsu Seisakusho Ltd.), and a carbon fiber bundle produced by carbonizing polyacrylonitrile fibers was wound around a winding bobbin (paper tube) having an outer diameter of 80 mm, with a traverse width of 150 mm at a yarn speed of 7 m/min.

The angle d1 between the two yarn guides (the first yarn guide as the guide member A and the second yarn guide as the guide member B) constituting the yarn traverse guide TG1 was set at 90 degrees, and the clearance e was set at 10 mm.

As shown in Table 1, whenever the winding bobbin (paper tube) was moved in the direction of leaving from the pressure roller, the yarn did not deviate from the yarn traverse guide TG1 irrespective of the position of the yarn traverse guide TG1. Further, when the winding bobbin (paper tube) having the yarn wound around it at the center was merely brought into contact with the pressure roller, the yarn could be automatically introduced into the yarn traverse guide TG1. The carbon fiber bundle wound around the winding bobbin showed some fuzz, but it was trivial.

EXAMPLE 2

The yarn traverse guide TG2 shown in FIG. 11 was attached to a turret (revolving) type yarn winder (EKTW-CA winder produced by Kamitsu Seisakusho Ltd.), and a carbon fiber bundle produced by carbonizing polyacrylonitrile fibers was wound around a winding bobbin (paper tube) having an outer diameter of 80 mm, with a traverse width of 150 mm at a yarn speed of 7 m/min.

The angle d2 between the two yarn guides (the first yarn guide as the guide member C and the second yarn guide as the guide member D) constituting the yarn traverse guide TG2 was set at 50 degrees, and the clearance e was set at 5 mm.

As shown in Table 1, whenever the winding bobbin (paper tube) was moved in the direction of leaving from the pressure roller, the yarn did not deviate from the yarn traverse guide TG2 irrespective of the position of the yarn traverse guide TG2. Further, when the winding bobbin (paper tube) having the yarn wound around it at the center was merely brought into contact the pressure roller, the yarn could be automatically introduced into the yarn traverse guide TG2. The carbon fiber bundle wound around the winding bobbin did not show fuzz.

COMPARATIVE EXAMPLE 1

A carbon fiber bundle was wound around a winding bobbin (paper tube) as described in Example 1, except that the yarn traverse guide as shown in FIGS. 3 and 4 of Patent Document 3 was used.

In the yarn traverse guide used, the yarn arresting groove, the yarn disengagement prevention hook and the yarn guide portion were respectively disposed to ensure that the clearance between the yarn arresting groove and the tip portion of the yarn disengagement prevention hook became 1 mm and that the end portion of the yarn disengagement prevention hook became flush with the yarn guide portion positioned on the other side of the yarn arresting groove (for facing the 0 mm site direction).

As shown in Table 1, whenever the winding bobbin (paper tube) was moved in the direction of leaving from the pressure roller, the yarn did not deviate from the yarn traverse guide irrespective of the position of the yarn traverse guide. However, when the winding bobbin (paper tube) having the yarn wound around it at the center was merely brought into contact with the pressure roller, the yarn could not be automatically introduced into the yarn traverse guide. Therefore, the yarn was introduced into the yarn traverse guide manually. The carbon fiber bundle wound around the winding bobbin showed some fuzz, but it was trivial.

COMPARATIVE EXAMPLE 2

A carbon fiber bundle was wound around a winding bobbin (paper tube) as described in Comparative Example 1, using the yarn traverse guide used in Comparative Example 1. However, the yarn arresting groove and the yarn disengagement prevention hook were disposed to ensure that the clearance between the yarn arresting groove and the tip portion of the yarn disengagement prevention hook became 10 mm.

As shown in Table 1, when the winding bobbin (paper tube) having the yarn wound around it at the center was merely brought into contact with the pressure roller, the yarn could be automatically introduced into the yarn traverse guide. However, when the winding bobbin (paper tube) was moved in the direction of leaving from the pressure roller, the yarn deviated from the yarn traverse guide with the yarn traverse guide located at 112.5 mm site and 150 mm site. The carbon fiber bundle wound around the winding bobbin showed some fuzz, but it was trivial.

COMPARATIVE EXAMPLE 3

A carbon fiber bundle was wound around a winding bobbin (paper tube) as described in Example 1, except that the yarn traverse guide described in Patent Document 1 was used.

As shown in Table 1, when the winding bobbin (paper tube) having the yarn wound around it at the center was merely brought into contact with the pressure roller, the yarn could be automatically introduced into the yarn traverse guide. However, when the winding bobbin (paper tube) was moved in the direction of leaving from the pressure roller, the yarn deviated from the yarn traverse guide irrespective of the position of the yarn traverse guide. The carbon fiber bundle wound around the winding bobbin did not show fuzz.

TABLE 1

| | Yarn introduction | Stability of yarn passage control Whether or not the yarn deviated from the traverse guide Site (mm) | | | | |
|---|---|---|---|---|---|---|
| | | 0 | 37.5 | 75 | 112.5 | 150 |
| Example 1 | Easy | Did not | Did not | Did not | Did not | Did not |
| Example 2 | Easy | Did not | Did not | Did not | Did not | Did not |
| Comparative Example 1 | Difficult | Did not | Did not | Did not | Did not | Did not |
| Comparative Example 2 | Easy | Did not | Did not | Did not | Did | Did |
| Comparative Example 3 | Easy | Did | Did | Did | Did | Did |

In the yarn traverse guide of the invention, even in the case where the force in the yarn running direction and the force in the direction different from the traverse direction act on the yarn, the yarn does not deviate from the yarn traverse guide, and the state where the yarn is stably arrested by the yarn traverse guide can be sustained. The yarn traverse guide of the invention allows the yarn to be easily threaded into the yarn traverse guide. The yarn traverse guide of the invention can be suitably used in a yarn winder such as a turret (revolving) type yarn winder, in which the force in the yarn running direction and the force in the direction different from the traverse direction act on the yarn during the automatic transfer of the yarn from a fully loaded bobbin to an empty bobbin, though such forces do not act on the yarn in the steady winding state.

The invention claimed is:

1. A yarn traverse guide comprising:

(a) a first guide member forming a first yarn guide, (b) a second guide member forming a second yarn guide, and (c) a guide attaching member mounting said first guide member and said second guide member, wherein (d) said first guide member has a first yarn introducing port formed in a peripheral segment thereof and a first yarn introducing passage extending from said first yarn introducing port to inward of said first yarn introducing port, (e) said second guide member defines a second yarn introducing port and a second yarn introducing passage extending from said second yarn introducing port to inward of said second yarn introducing port, and (f) said first yarn guide and said second yarn guide are coupled to said guide attaching member in facing relationship to each other through a clearance between them, and extend in the same direction from said guide attaching member, in such a state that when said first yarn introducing port and said second yarn introducing port are projected on the same plane of projection, they do not overlap each other and in such a state that when said first yarn introducing passage and said second yarn introducing passage are projected on the same plane of projection, they overlap each other at least partially, and wherein (g) said second guide member comprises two bars disposed parallel to one another with a clearance kept between them in which said clearance between said two bars forms said second yarn introducing passage, and an inlet of said clearance forms said second yarn introducing port, and further wherein said first guide member comprises a plate body, and each of said two bars of said second guide member is a rotatable roller.

2. A yarn traverse guide, according to claim 1, wherein an angle formed between a first direction in which a center line of said first yarn introducing passage extends from said first yarn introducing port to outward of said first guide member and a second direction in which a center line of said second yarn introducing passage extends from said second yarn introducing port to outward of said second guide member is more than 0 degree to less than 180 degrees on said same plane of projection.

3. A yarn traverse guide, according to claim 2, wherein the center line of said first yarn introducing passage is straight.

4. A yarn traverse guide, according to claim 2, wherein said first yarn introducing passage communicates, at its end, with a yarn introducing passage extension extending in a direction different from a direction of the center line of the first yarn introducing passage.

5. A yarn traverse guide, according to claim 1, wherein the peripheral segment including said first yarn introducing port of said first guide member is formed to be curved outward of the first guide member.

6. A yarn traverse guide, according to claim 1, wherein the first yarn introducing passage of said first guide member communicates, at its end, with a yarn introducing passage extension extending in a direction different from the direction of a center line of said first yarn introducing passage; and in the case where said yarn introducing passage extension and the second yarn introducing passage formed between said rotatable rollers are projected on the same plane of projection, they agree with each other in direction.

7. A yarn traverse guide comprising:

guide members each defining a yarn introducing port and a yarn introducing passage extending from said yarn introducing port inwardly from said yarn introducing port;

a guide attaching member mounting the guide members such that they face each other with a clearance between them and extend in the same direction from said guide attaching member;

wherein when said yarn introducing ports of said guide members are projected on a plane of projection, they do not overlap each other;

wherein when said yarn introducing passages of said guide members are projected on the same plane of projection, they overlap each other at least partially; and wherein one of said guide members comprises two bars disposed parallel to one another with a clearance kept between them in which said clearance between said two bars forms said yarn introducing passage of said one of said guide members, and an inlet of said clearance forms said yarn introducing port of said one of said guide members, and further wherein another one of said guide members comprises a plate body, and each of said two bars of said one of said guide members is a rotatable roller.

8. A yarn traverse guide, according to claim 7, wherein an angle formed between a center line of each of said yarn introducing passages extending from each of said yarn introducing ports outwardly is more than 0 degree to less than 180 degrees.

9. A yarn traverse guide, according to claim 8, wherein a center line of at least one of said yarn introducing passages is substantially straight.

10. A yarn traverse guide, according to claim 8, wherein one or more of said yarn introducing passages communicates, at its end, with a yarn introducing passage extension extending in a direction different from a direction of the center line of the one or more yarn introducing passages.

11. A yarn traverse guide, according to claim 7, wherein a peripheral segment including said yarn introducing port of at least one of said guide members is formed to be curved outwardly of the at least one guide member.

12. A yarn traverse guide, according to claim 7, wherein the yarn introducing passage of said plate body communicates, at its end, with a yarn introducing passage extension extending in a direction different from the direction of the center line of said yarn introducing passage; and in the case where said yarn introducing passage extension and the yarn introducing passage formed between said rotatable rollers are projected on the same plane of projection, they agree with each other in direction.

* * * * *